United States Patent [19]

Araki et al.

[11] Patent Number: 4,888,615

[45] Date of Patent: Dec. 19, 1989

[54] IMAGE FORMING APPARATUS FOR SELECTIVE COPYING OF SEGMENTED AREAS OF AN IMAGE

[75] Inventors: Kazuhiro Araki; Nobuhiro Mishima, both of Osaka, Japan

[73] Assignee: Minolta Camera Kabushiki Kaisha, Osaka, Japan

[21] Appl. No.: 148,697

[22] Filed: Jan. 26, 1988

[30] Foreign Application Priority Data

Jan. 27, 1987 [JP] Japan ..... 62-17023

[51] Int. Cl.[4] ..... G03G 15/00

[52] U.S. Cl. ..... 355/200; 355/218; 355/244

[58] Field of Search ..... 355/14 R, 7, 3 R, 67, 355/75, 77, 200, 218, 244; 358/283

[56] References Cited

U.S. PATENT DOCUMENTS

| | | | |
|---|---|---|---|
| 4,017,173 | 4/1977 | Komori et al. | 355/8 |
| 4,068,948 | 1/1978 | Ritzerfeld | 355/75 |
| 4,256,400 | 3/1981 | Komori et al. | 355/14 SH |
| 4,582,417 | 4/1986 | Yagasaki et al. | 355/7 |
| 4,627,707 | 12/1986 | Tani et al. | 355/14 R |
| 4,653,899 | 3/1987 | Watanabe | 355/14 R |
| 4,740,818 | 4/1988 | Tsilibes et al. | 355/14 R |
| 4,752,809 | 6/1988 | Ito | 355/14 R |

FOREIGN PATENT DOCUMENTS

| | | |
|---|---|---|
| 5756859 | 7/1980 | Japan . |
| 5741671 | 8/1980 | Japan . |
| 5843480 | 9/1981 | Japan . |

*Primary Examiner*—A. C. Prescott

*Attorney, Agent, or Firm*—Price, Gess & Ubell

[57] ABSTRACT

An image forming apparatus having an original exposure device for exposing an original in a predetermined exposure area, a specific area designating device for selectively designating a specific area to be edited having a certain size in the exposure area, the specific area including a plurality of sectional blocks, a sectional block designating device for designating at least one desired sectional block from the plurality of blocks, and an image forming device for erasing an image of the original corresponding to the designated sectional block inside the specific area and reproducing the rest of the original image. As each of the designated specific area includes the same number of the sectional blocks, a convenient block size may be obtained by selecting the specific areas having different sizes. Also, it may be conveniently selected whether to copy or erase the original image outside the selected specific area.

13 Claims, 11 Drawing Sheets

IMAGE FORMING APPARATUS FOR SELECTIVE COPYING OF SEGMENTED AREAS OF AN IMAGE

BACKGROUND OF THE INVENTION

1. Field of the Invention

The present invention relates to an image forming apparatus such as a copier or a microfilm printer capable of selectively forming an image of only a desired or necessary portion of an original such as a newspaper having various information in a mixed state, and more particularly to an image forming apparatus of the above-described type comprising an image-forming optical system for forming an electrostatic latent image of an image light by irradiating the image light reflected from an original to be scanned onto a photosensitive member, means for dividing a latent image forming area on the photosensitive member into a plurality of sectional blocks and designating a particular block from the plurality of blocks and image forming means for reproducing an image of the original corresponding to the sectional blocks except the designated blocks inside the designated specific area.

2. Description of the Prior Art

As the means for designating a particular sectional block when only a desired portion of the original document is to be copied, there is known for example a method of setting a two-dimensional coordinate corresponding to the document and inputting by means of, e.g. a ten key pod, coordinate values defining the particular area.

However, in the case of this method, the setting operation is very troublesome and there tends to occur errors in the operation. Thus, there is known another method in which a copiable area is divided into a plurality of sectional blocks and a user may determine for each block whether the same is to be copied or not.

According to this method however, although the area (block) to be copied may be set by a simple operation, each block has a predetermined size and therefore there occur inconveniences to be described next.

That is, if the predetermined size of the sectional block is large, it is impossible to carry out a fine edit operation. On the other hand, if the block size is predetermined to be small for carrying out a fine edit operation, section designating keys need be operated many times whereby the copy area setting operation becomes troublesome. Further, this block designating method is disadvantageous and inconvenient in that the area to be copied is not designed to correspond to various sizes of original documents.

SUMMARY OF THE INVENTION

Therefore, it is the primary object of the present invention to provide an image forming apparatus capable of variably setting an area to be copied depending on a size or the like of an original with a simple operation.

For accomplishing the above object, an image forming apparatus related to the present invention comprises:

original exposure means for exposing an original in a predetermined exposure area:

specific area designating means for selectively designating a certain specific area in the exposure area, the specific area including a plurality of sectional blocks;

sectional block designating means for designating at least one sectional block from the plurality of blocks; and image forming means for reproducing an image of the original corresponding to the sectional blocks outside the designated block in the specific area.

According to the above image forming apparatus, as a certain specific area in the exposure area is selectively designated by the specific area designating means, the size of each block constituting this specific area is determined. That is to say, by selecting a specific area having an appropriate size, it is possible to obtain a group of sectional blocks each having an appropriate size.

As the result, by properly selecting the size of the specific area based on a positional relationship, relative sizes or the like between a portion to be copied and a portion not to be copied of the original document, it is possible to reduce overlapping of sectional blocks corresponding to the portion to be copied with the portion not to be copied thereby reducing copied area of the unnecessary portion. Especially, in the case of edit-copying a partial area of an original document, by corresponding the size of the specific area not to that of the whole document but to that of the partial area to be edit-copied, the size of each sectional block is reduced. That is, since it is possible to finely divide the partial area to be edit-copied, the portion to be copied and the portion not to be copied may be finely defined whereby the copied area of the unnecessary portion may be advantageously reduced.

Moreover, according to a preferred embodiment of the present invention, the plurality of specific areas selectively designated by the specific area designating means have sizes different from each other with each specific area including the same number of sectional blocks. With this arrangement, although each sectional block has a small size, the number of sectional blocks remain the same regardless of the selected specific area. Thus, the copy area setting operation may be carried out easily whether the specific area has a large size or a small size.

That is to say, according to the image forming apparatus having the above-described construction, since the specific area as a latent image forming area is divided into the same number of sectional blocks and it is possible to vary also the size of each sectional block by freely selecting the size of the specific area, the copy area may be set by using a desired size of sectional block as the minimum unit. Consequently, if the size of the specific area is varied depending on that of a portion to be copied, it becomes possible to obtain a desirable copy in which the copied area of an unnecessary portion is reduced.

Moreover, since the number of sectional blocks remain the same regardless of the selected specific area, the copy area setting operation may be carried out in a simple and easy manner.

In conclusion, the present invention has achieved an improved image forming apparatus characterized by easy operation and a distinguished edit feature.

The above and other objects, features and advantages of the present invention will become more apparent from the following detailed description of preferred embodiments taken with the accompanying drawings.

BRIEF DESCRIPTION OF THE DRAWINGS

Accompanying drawings illustrate preferred embodiments of an image forming apparatus related to the present invention, in which.

DESCRIPTION OF THE PREFERRED EMBODIMENTS

Preferred embodiments of the present invention will be particularly described hereinafter with reference to the accompanying drawings.

Figure 1:
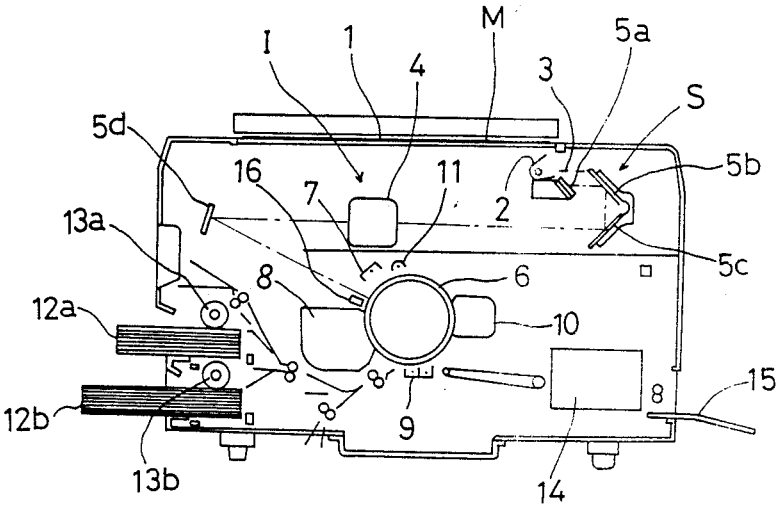
FIG. 1 is a schematic sectional view showing an electronic photographic copier as an embodiment of the image forming apparatus related to the present invention.

FIG. 1 is a sectional view schematically showing a slit-scanning type electronic photographic copier as an example of an image forming apparatus related to the present invention.

In the construction shown in the same figure, an original document M placed on a document table 1 is irradiated by an exposure lamp 2 and an image light from the document M passes a slit 3 to be projected through an image forming optical unit I including an image forming lens 4, and a plurality of mirrors 5A through **5*d* onto a photosensitive drum 6**.

The exposure lamp 2, the slit 3 and the first mirror **5*a* constitute a scanning device S driven leftwardly in the same figure by a DC motor (not shown) at a velocity v to scan the document M. Also, the second mirror 5*b* and the third mirror 5*c*** are driven by the same DC motor at a half speed v/2 of that of the moving speed v of the scanning device S in order to maintain a constant image forming optical path length by the image forming optical unit I.

The image light from the document M having been scanned by the above scanning device S is applied onto the photosensitive drum 6 driven counterclockwise in the same figure by means of another motor (not shown) thereby forming an electrostatic latent image on the drum.

About the photosensitive drum 6 as an example of a photosensitive member, there are provided an electric charger 7 for uniformly charging a surface of the drum 6, a developing device 8 for transforming the electrostatic latent image formed by the projecting image formation by the image forming optical unit I into a visible image by affixing toner to the latent image, a transfer separator 9 for transferring the visible image onto a recording paper P and at the same time for separating this recording paper P from the photosensitive drum 6, a cleaning device 10 for removing excess toner adhered to the drum surface after the image transfer, a main eraser lamp 11 for discharging the electric charge on the surface of the photosensitive drum 6 after the image transfer, and so on.

Referring to the recording paper P, two kinds of papers of two different sizes are respectively accommodated in paper supply cassettes **12*a*, 12*b*, such that the paper P of a desired size may be picked up one by one by means of a pick-up roller 13*a* or 13*b* to be transported to the transfer separator 9**.

The recording paper P carrying the visible image transferred from the surface of the photosensitive drum 6 by the transfer separator 9 is delivered to a fixing device 14. Then, after the toner for forming the transferred visible image is fixed thereon through heating and fusing by the fixing device 14, the paper P is delivered onto a tray 15 disposed outside the copier.

Further, in this electronic photographic copier, before the developing device 8, there is provided a sub-eraser lamp 16 for copying only a necessary portion of the original document M. Therefore, it is possible to obtain a copy of only the necessary portion from the document M such as a newspaper having various information in a mixed state.

This sub-eraser lamp 16 is constituted by an LED array aligned in a longitudinal side thereof with a direction normal to the scanning direction (the direction normal to the document face) and has a length substantially equal to that of the photosensitive drum 6.

In operation, by illuminating this sub-eraser lamp 16 while a portion carrying the electrostatic latent image of the photosensitive drum 6 corresponding to the unnecessary portion of the document M passes therebelow, the portion irradiated by this sub-eraser lamp 16 loses its electric charge. And also, by disilluminating this sub-eraser lamp 16 while the rest portion of the drum 6 passes therebelow, only the latent image for the necessary portion of the document M may be transformed into a visible image by the developing device 8.

Nextly, the control device of this electronic photographic copier and its functions will be particularly described.

Figure 2:
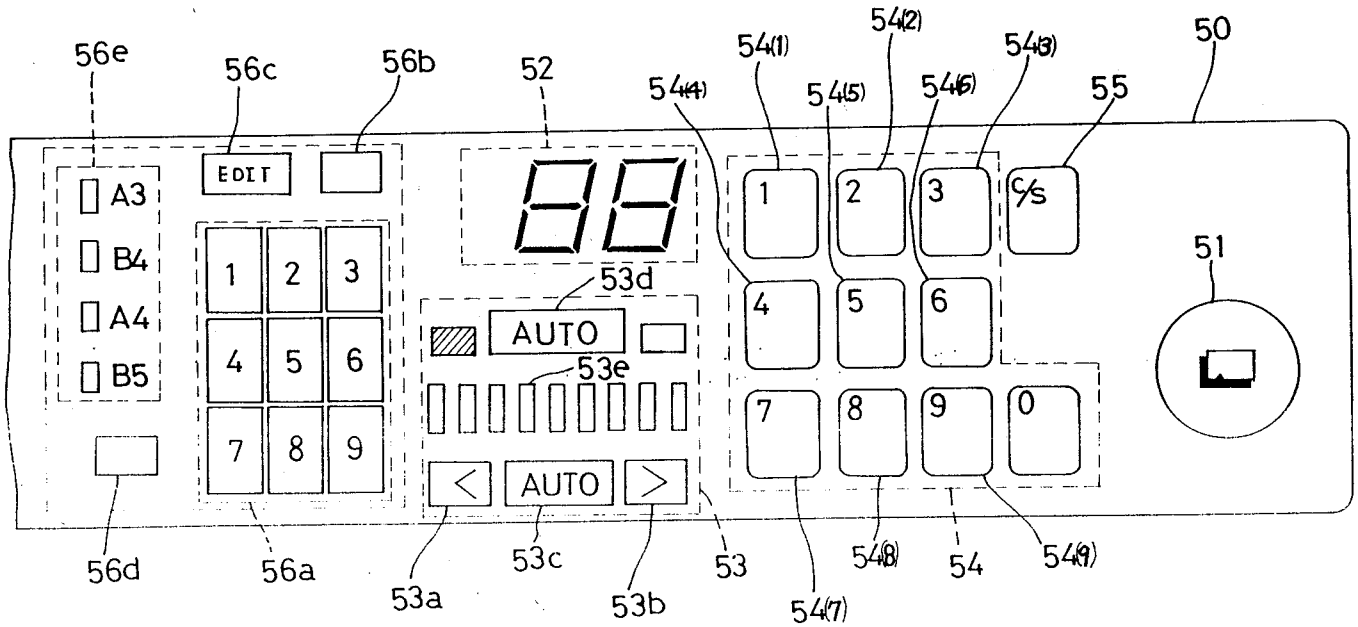
FIG. 2 is a plane view showing a portion of a control panel.

FIG. 2 shows a control panel 50 of the copier. Referring to reference marks and numerals in the same figure, a numeral 51 denotes a print key and a numeral 52 denotes a display device for digital-displaying various information such as the number of copies. A reference numeral 53 denotes a copy density setting section in which a copy density may be set by depressing two keys **53*a*, 53*b*. A mark 53*c* denotes an automatic density setting key and a mark 53*d* denotes an automatic density setting display LED for indicating the operation of the automatic density setting key 53*c*. Further, a reference mark 53*e*** denotes a group of copy density display LED for stepwisely displaying a set copy density.

A reference numeral 54 denotes a ten key pad, by depressing certain key elements of which it is possible to set the number of copies and a copy area to be described later. A reference numeral 55 denotes a clear-stop key for clearing the number of copies input by the ten key pad 54 and for interrupting an ongoing copying operation.

A reference numberal 56 denotes a copy area setting section for editing the original document M. Referring more particular to this section, a mark **56*a* denotes an edit area display section for displaying a specific area, i.e. an editable area in the form of nine sectional blocks and a window of each display section carrying a number incorporates an LED. In operation, only a portion of the document M corresponding to an illuminating window(s) of the display windows of the edit specific area display section 56***a* is copied as will be more particularly described later.

A reference mark 56*b* denotes an edit mode setting key. By depressing this key 56*b*, an edit mode is set with all the display windows of the edit specific area display section 56*a* being illuminated. In this edit mode, the number carried by each display window corresponds to the ten key 54, and the display window carrying a number of the depressed ten key 54 is disilluminated. A reference mark 56*c* denotes an edit mode display LED for indicating the edit mode.

A mark 56*d* denotes an edit area size key for selecting a specific area to be edited. With each depressing operation of this key 56*d*, the total size of the editable specific area may be successively switched to A3, B4, A4 and B5. A reference mark 56*e* denotes an edit area size display LED for displaying the size of the specific area to be edited set by the above edit area size key 56*d*.

By switching the size of the specific area to be edited by using the above edit area size key 56*d*, the size of each of the nine sectional blocks may be also varied. Therefore, by varying the size of the specific area to be edited depending on the desired fineness of the edit operation, it is possible to set the copy area with least possible unnecessary copy area.

This operation will be particularly described next using FIGS. 3A and 3B, in which the document M has the size of A4.

Figure 3A:
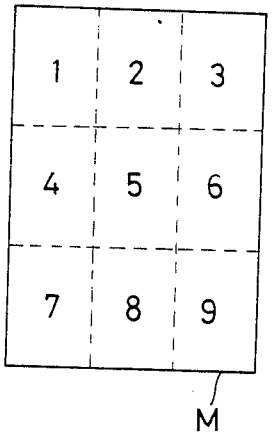
FIGS. 3A and 3B are plane views illustrating a relationship between an original document and sectional blocks constituting a specific edit area.

FIG. 3A shows a condition in which the specific area to be edited is set to A4 by the edit area size key 56*d*. In the same figure, the numbers denote those carried by the respective display windows of the edit area display section 56*a*. That is to say, although the whole document M may be edited, the fineness of the edit operation is limited by the size of each sectional block.

Figure 3B:
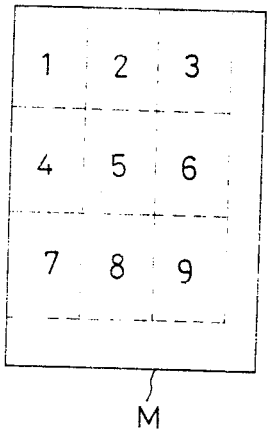

On the other hand, FIG. 3B shows a condition in which the specific area to be edited is set to B5 by the edit area size key 56*d*. In this figure also, the numbers denote those carried by the respective display windows of the edit area display section 56*a*. In this case, compared with the previous case in which the A4 size is set, it is possible to edit the document M more finely. It is to be noted here that the document image except the specific edit area undergoes a normal coying operation.

Figure 4:
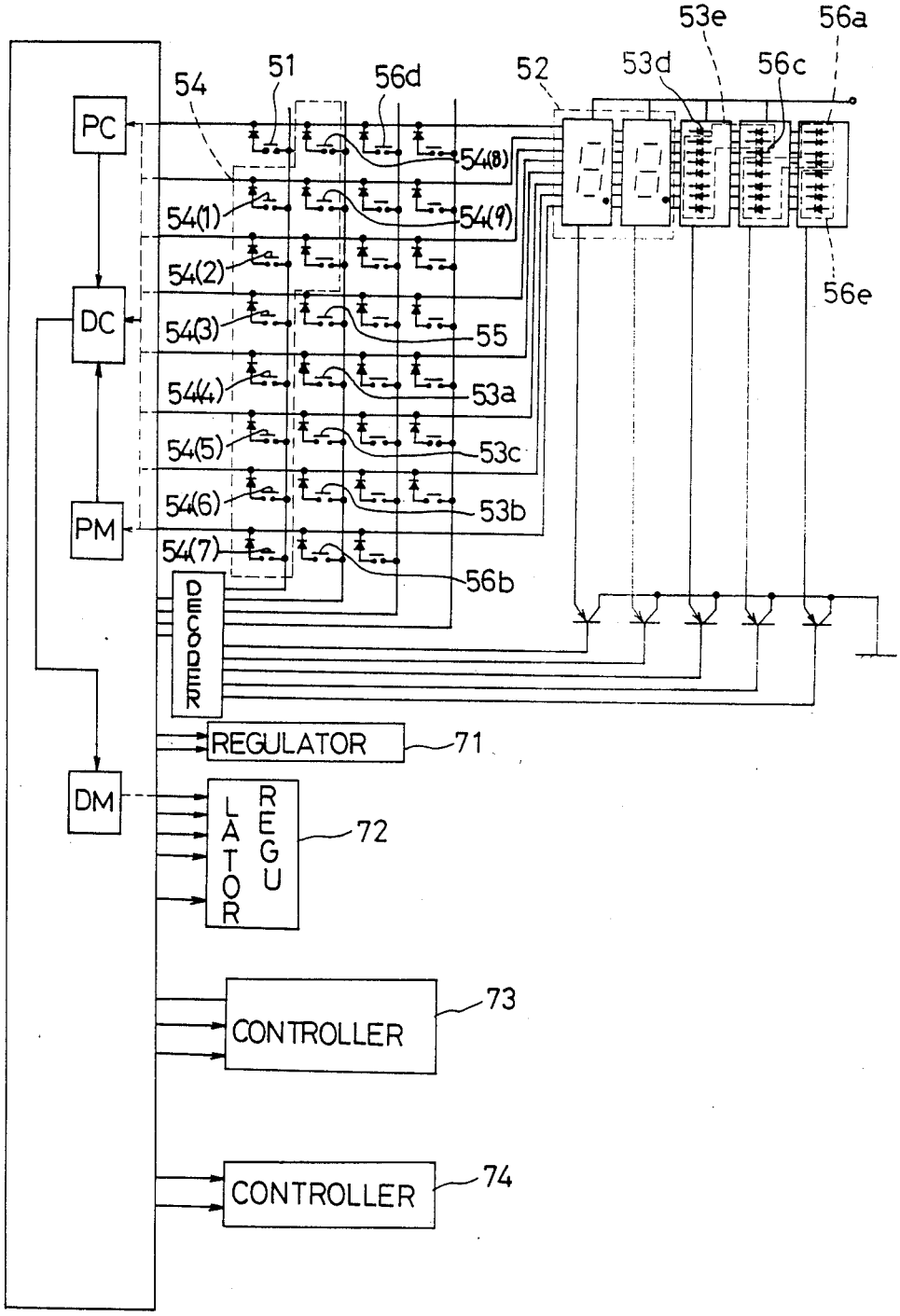
FIG. 4 is a block diagram of a control device.

FIG. 4 is a block diagram of the control device of this electronic photographic copier.

A CPU 70 of a microcomputer constituting a main component of this control device determines a copy mode based on input e.g. from the respective keys of the control panel 50 and displays the copy mode. Further, this CPU 70 controls operations of a sub-eraser lamp regulator 72 for the sub-eraser lamp 16, a controller 73 for the DC motor for driving the scanning device S and of a controller 74 for a drive stepping motor for varying a conjugate length of the image forming optical unit I.

By receiving an illumination signal or a disillumination signal from the CPU 70, the sub-eraser regulator 72 controllably illuminates or disilluminates each LED of the LED array constituting the sub-eraser lamp 16, whereby in the specific area to be edited only the selected area is copied as described hereinbefore.

By receiving a drive control signal for normal rotation or for reverse rotation from the CPU 70, the controller 73 for the DC motor for driving the scanning device S controls linear movements, reversing movement and stop of the scanning device S. Further, this controller 73 generates to the CPU 70 a signal which comprises a rectified signal of a pulse signal from an optical encoder attached to the driving DC motor, whereby a position of the scanning device S may be detected based on this input signal.

In this figure, the numbers same as those in FIG. 1 respectively denote the keys on the control panel 50 and the LEDs.

The CPU 70 has four functions to be described next. Firstly, the CPU has an area division setting function PM for dividing the latent image forming area on the photosensitive drum 6 into a plurality of sectional blocks as receiving from the aforementioned edit mode setting key 56 an input signal for switching over to the edit mode. Secondly, the CPU has a divisional developing function DM for independently transforming each sectional block into a visible image by controllably activating the developing device 8 and the sub-eraser lamp 16. Thirdly, the CPU has a development control function DC for selecting the sectional block to be developed defined by the above divisional developing function DM based on an input signal from the ten key 54. Fourthly, the CPU has an edit area varying function PC for varying the size of the latent image forming area on the photosensitive drum 6 based on an input signal from the edit area size key 56*d*.

These functions of this electronic photographic copier will be particularly described next with reference to flow charts shown in FIGS. 5 through 7. Firstly, the meaning of a term 'ON-EDGE' will be defined next.

This term 'ON-EDGE' means a transition from an 'OFF' state to an 'ON' state of a switch.

Figure 5:
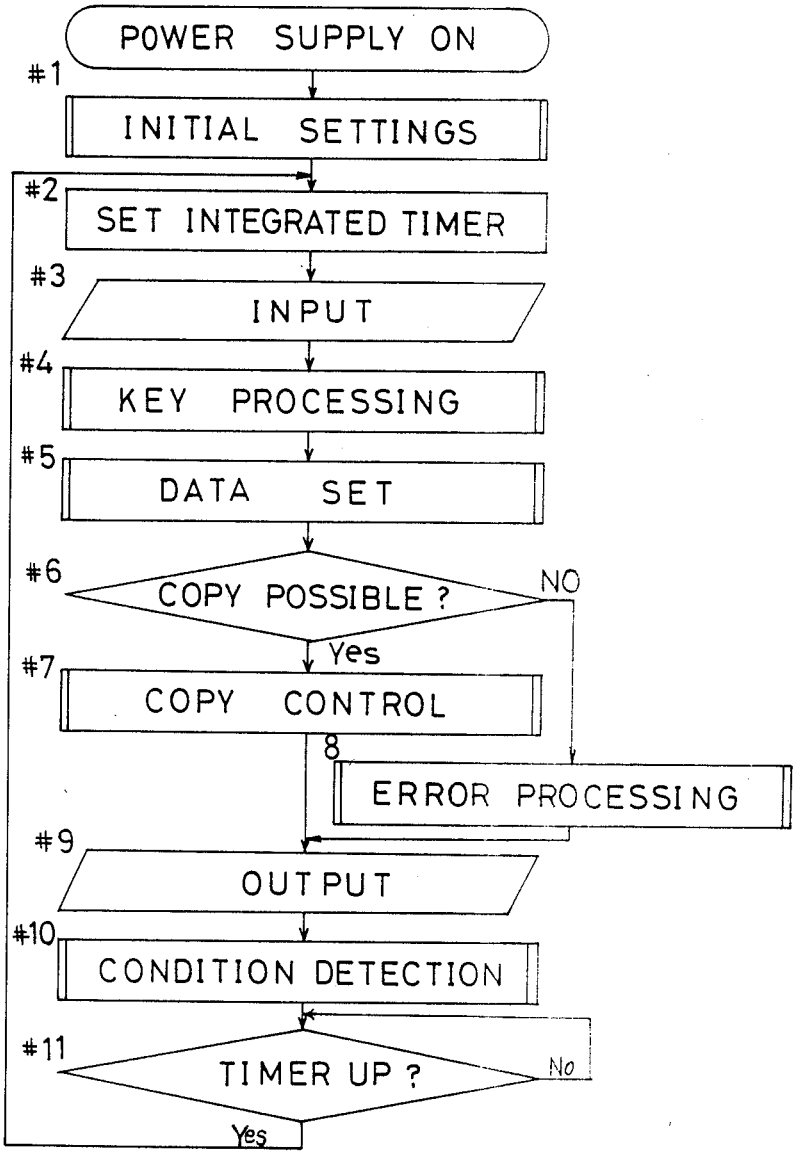
FIG. 5, FIGS. 6A, 6B and 6C and FIGS. 7A and 7B are flow charts illustrating functions of the electronic photographic copier.

FIG. 5 shows a mainroutine for controlling the overall flow of a copy operation.

Referring to this mainroutine, when this mainroutine is started with supply of power, at step #1, initial setting operations are carried out for clearing all of registers, flags, RAMs and the like provided inside the CPU 70. At step #2, an integrated timer for setting a time period of one routine is set.

At step #3, the aforementioned inputs from the respective keys of the control panel 50 or from the switches and sensors disposed separately from the keys are processed. At step #4, a key-processing subroutine is called for processing the above inputs from the respective keys of the control panel 50. Nextly, at step #5, a data-setting subroutine is called for setting display data. These subroutines will be particularly described later.

At step #6, it is judged whether a copy operation is possible or not, i.e. whether any error is present or not. If not, a normal copy operation is carried out at step #7. On the other hand, if some error is detected, an error processing is carried out at step #8. In either of the above cases, a control signal or a display signal is generated at step #9.

At step #10, presence or absence of the developing toner and of the recording paper P in the paper supply cassette 12*a* and also presence or absence of temperature abnormality in the fixing roller of the fixing device 14 and so on are all judged. At step #11, the process waits for a timing-up of the integrated timer. With this timing up of the timer, the process returns to step #2 and thereafter repeats the above operations.

Figure 6A:
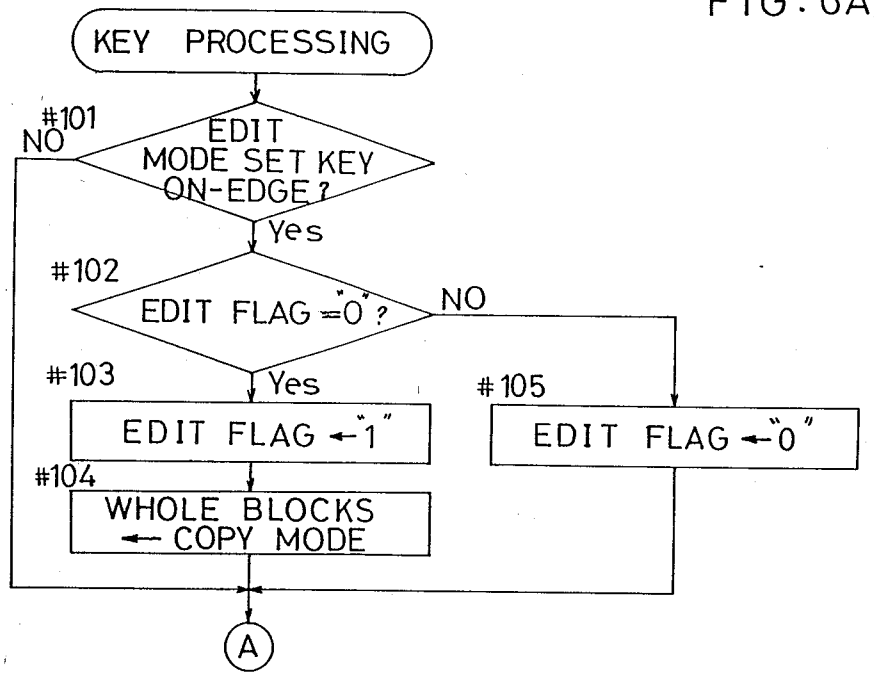
Figure 6B:
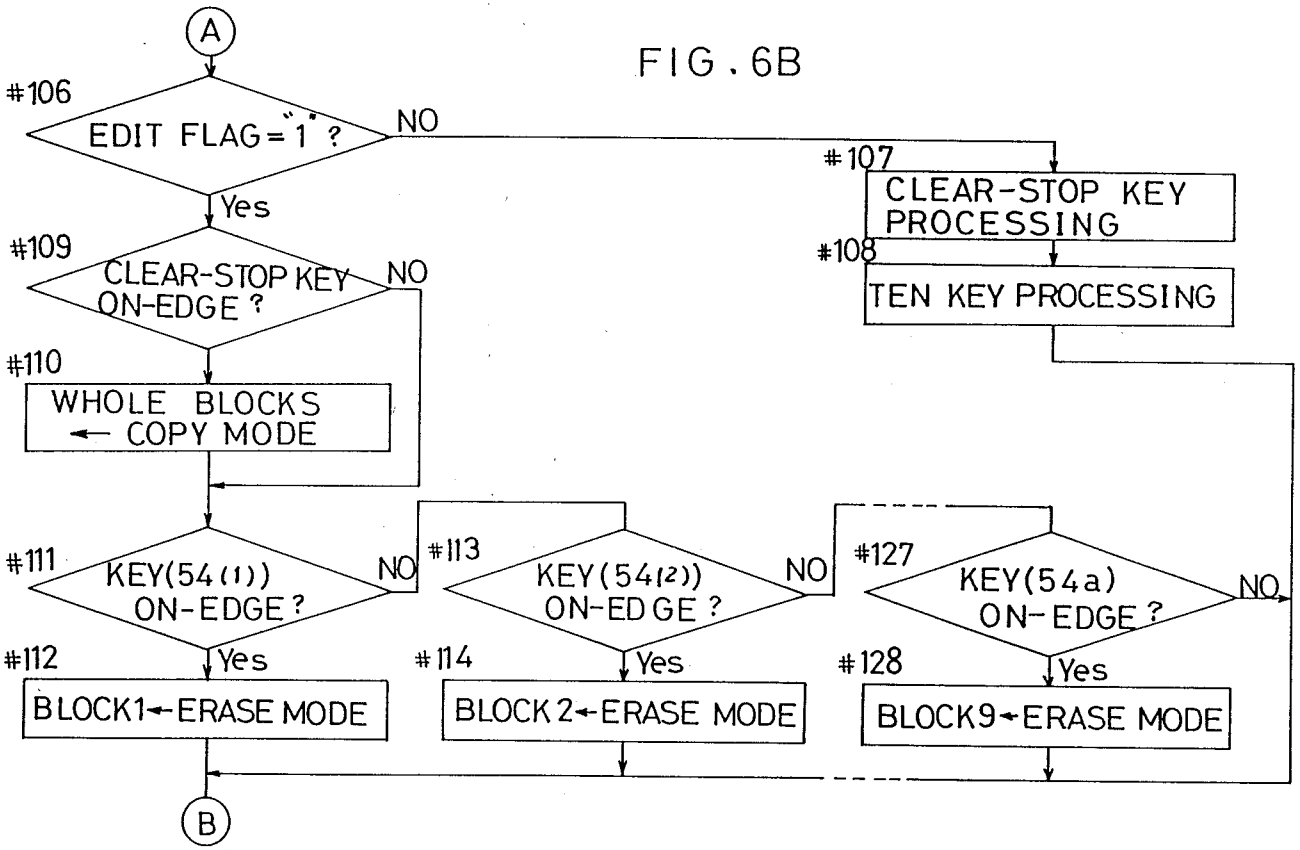
Figure 6C:
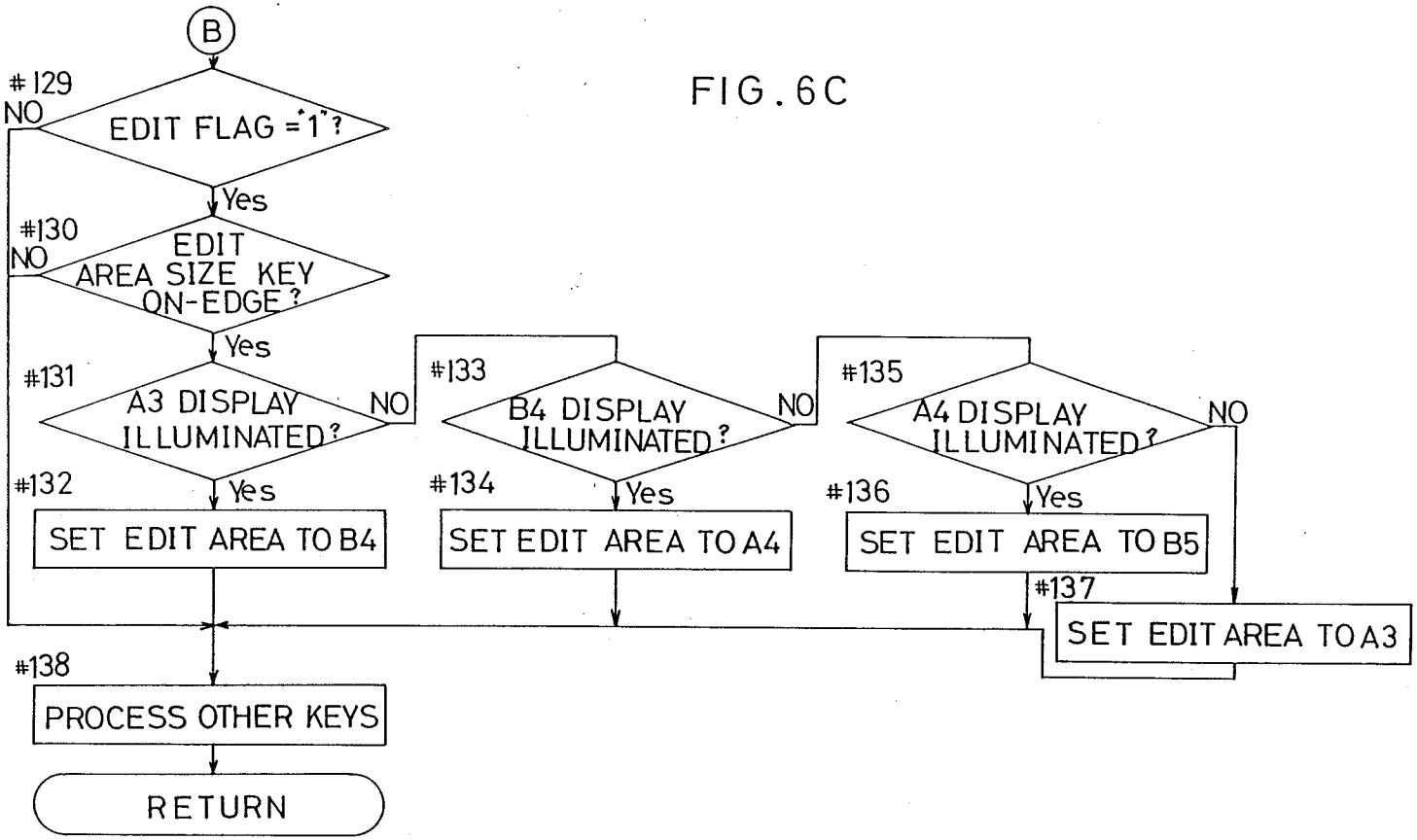

FIGS. 6A, 6B and 6C together show a flow chart of the key-processing subroutine called at step #4.

When this subroutine is called, at step #101, it is judged whether the edit mode setting key 56b has been operated or not. With detection of ON-EDGE of this key 56b, at step #102, an edit flag is judged. This edit flag is set to '1' only in the edit mode.

If this flag is set to '0', the same is set to '1' at step #103 and then at step #104 all of the editable areas (to be referred to as the whole blocks hereinafter) are set to a copy mode, i.e. a mode for carrying out a copying operation. On the other hand, if the edit flag is set to '1', this edit flag is set to '0' to return to the standard mode at step #105.

With completion of the above operatons, if absence of ON-EDGE of the edit mode setting key 56b is judged at step #101, the edit flag is again judged at step #106.

If the edit flag is set to '0', i.e. in the case of the standard mode, a clear stop key processing for clearing the set copy number of stopping the copy operation is carried out at step #107. Then, at step #108, the copy number corresponding to the ON-EDGEed key of the ten key 54 is set.

If it is judged at step #106 that the edit flag is set to '1', i.e. in the case of the edit mode, presence or absence of ON-EDGE of the clear stop key 55 is judged at step #109. With presence of ON-EDGE of this key 55, the whole blocks are set to the copy mode at step #110 and then the process goes on to the sequential steps after step #111. On the other hand, with an absence of ON-EDGE of this key 55, the process goes on to the steps after step #111 without carrying out any operations.

At steps #111 through #128, presence or absence of ON-EDGE of keys 54(l) through 54(O) corresponding respectively to the numbers carried by the ten key pad 54 is judged. And, a sectional block corresponding to the ON-EDGEed key (will be referred hereinafter to blocks 1 through 9 corresponding respectively to the numbers of the ten key pad 54) is set to an erase mode, i.e. to a non-copy mode.

With completion of the above processing in the edit mode and also with completion of the clear stop processing and the ten key processing in the standard mode, the edit flag is again judged at step #129.

If the edit flag is judged to be '1', i.e. in the standard mode, presence or absence of ON-EDGE of the edit area size key 56d is judged at step #130. With presence of ON-EDGE of this key 56d, the process goes on to flow after step #131.

At steps #131 through #137, it is judged which of the LED element of the edit area size display LED 56e illuminated in accordance with the edit specific area size successively and variably set by a depressing operation of the edit area size key 56d is illuminated, and then the size of the edit area is set depending on the judgement.

After completion of the above processing and if it is judged at step #129 that the mode is the standard mode and also in the case of absence of ON-EDGE of the edit area size key 56d, after carrying out other key processings such as processing of operations of the three density setting keys 53a through 53c and of the print key 51, the process returns to the mainroutine.

Figure 7A:
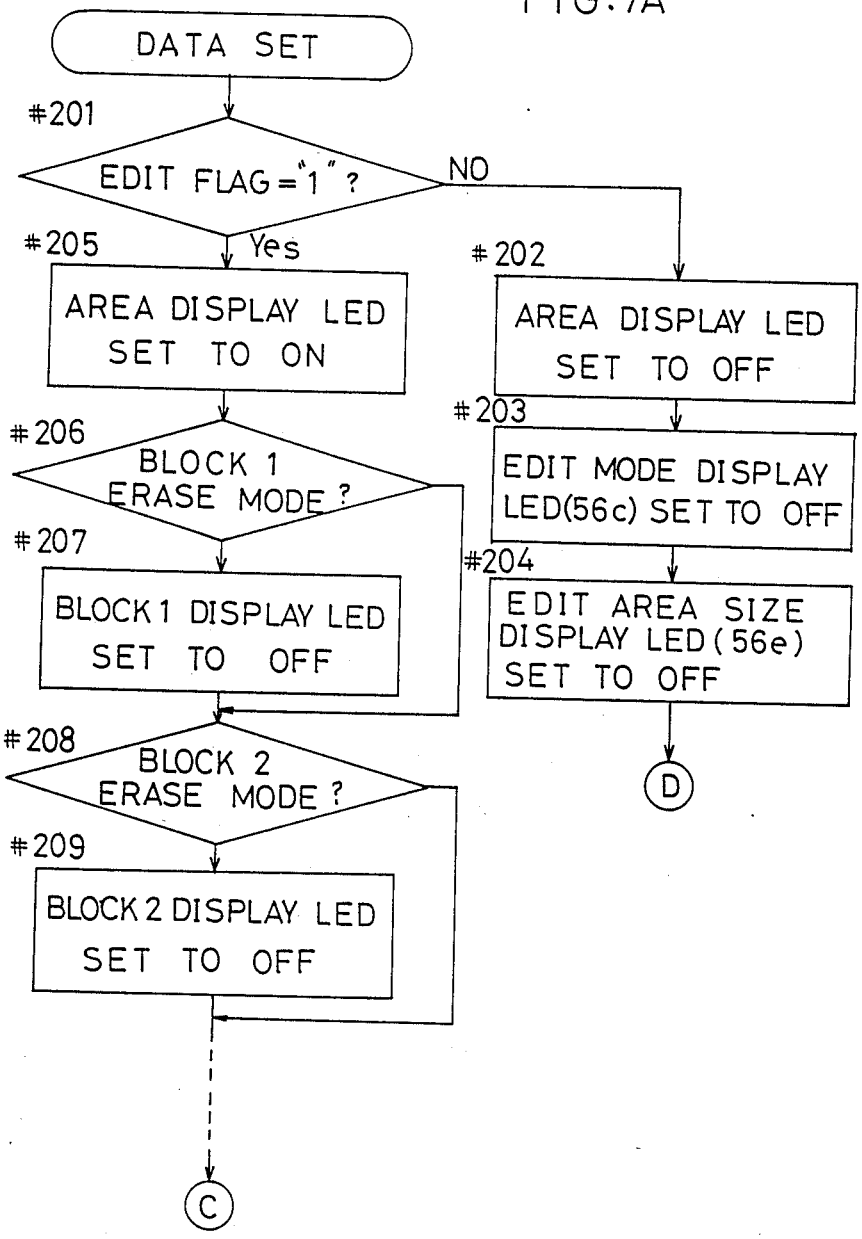
Figure 7B:
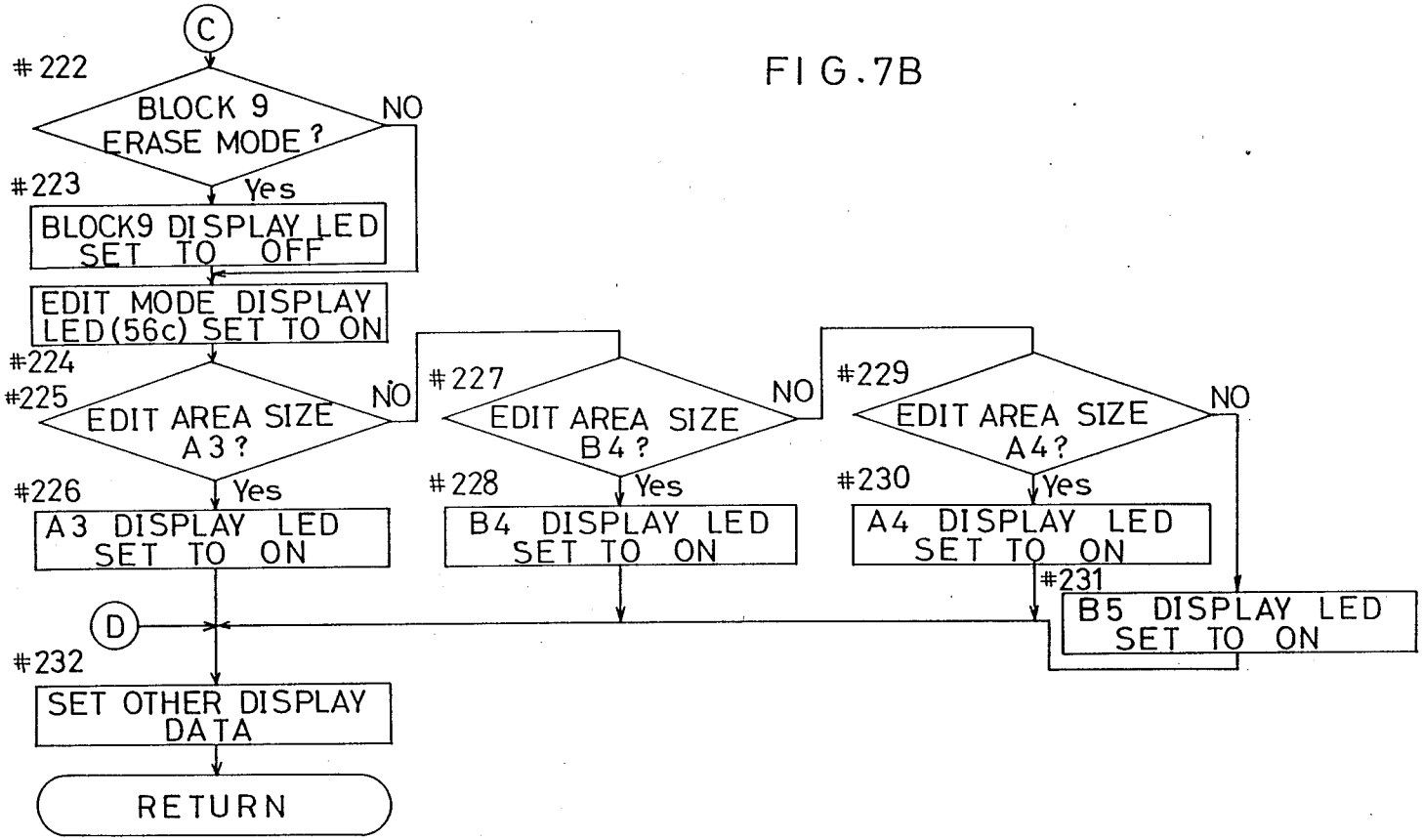

FIGS. 7A and 7B together show the data set subroutine called at step #5.

When this data set subroutine is called, firstly at step #201, the edit flag is judged.

In case this edit flag is judged to be '0', i.e. in the case of the standard mode, at step #202 the LED elements of the respective display windows of the edit area display section 56a are disilluminated and then at steps #203 and #204 the edit mode display LED 56c and the edit area size display LED 56e are disilluminated.

On the other hand, in case the edit flag is judged to be '1', i.e. in the case of the edit mode, at step #205 the LED elements of the respective display windows of the edit area display section 56a are illuminated and then the process goes on to steps after step #206.

At steps #206 through #223, it is judged whether or not each sectional block is set to the erase mode and the LED element of the display window of the edit area display section 56a corresponding to the set sectional block is disilluminated. Thereafter, at step #224 the edit mode display LED 56c is illuminated and then the process goes on to the steps after step #225.

At steps #225 through #231, it is judged as to which size the edit specific area is set, and depending on the set size the corresponding LED element of the edit area display LED is illuminated.

After completion of the above processing in the edit mode and after completion of the processing from step #202 through #204 in the standard mode, other display data such as copy number data and copy density data are set at step #232 and then the process returns to the mainroutine.

In the previous embodiment, the size of the edit specific area is variably set to A3, B4, A4 and B5 in accordance with the recording papers of the standard types. In place of this, it is also possible to arrange the size of the specific edit area to other sizes and also the number of steps of this size variation may be conveniently varied. Further, the size may be successively and steplessly varied also.

In case the size of the specific edit area is adapted to be more finely varied, it is useful if the original document M size and the specific edit area set to correspond to the same are displayed together on the control panel 50.

In the previous embodiment, the specific area to be edited set by the edit area size key is divided into nine sectional blocks and the document image on the photosensitive drum 6 corresponding to the block designated by the ten key setting is erased not to be copied. In contrast to this, it is also possible to arrange such that the document image corresponding to the designated sectional block is to be copied.

Further, in the previous embodiment, the exposed document image except for the designated edit area is copied as it is. In contrast to this, the exposed document image except for the designated edit area may be erased so as not to be copied.

Because various alternatives are possible as described above, it is also possible for the present invention to provide a multi-functional image forming apparatus to be described next. For example, it is possible to provide the apparatus with a normal edit mode in which the document image corresponding to the designated sectional block within the specific area is erased so as not to be copied and a reverse edit mode in which only the document image corresponding to the designated block is copied, with these two modes being switchably selected by means of a first selector switch.

Further, the apparatus may additionally have a first copy mode in which exposed document image except for the designated area is copied and a second copy mode in which the same is erased not to be copied, with these two modes being switchably selected by means of a second selector switch.

Figure 8:
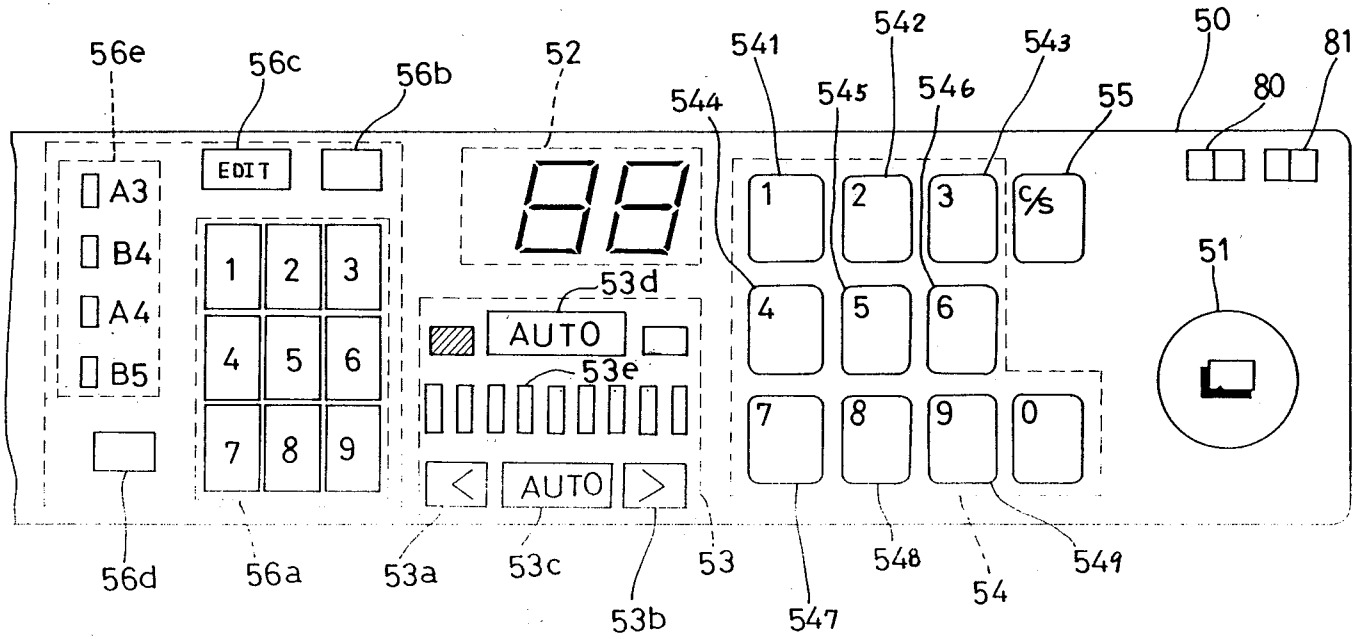
FIG. 8 is a plane view showing a portion of a control panel of an electronic photographic copier as an alternate embodiment of an image forming apparatus related to the present invention.

A control panel 50' of such a multi-functional copier is shown in FIG. 8. This control panel 50' differs from the control panel 50 shown in FIG. 2 in that the former carries at a right upper portion thereof the first selector switch 80 and the second selector switch 81.

A copying operation using this copier will be described next with reference to FIGS. 9A, 9B and 9C.

Figure 9A:
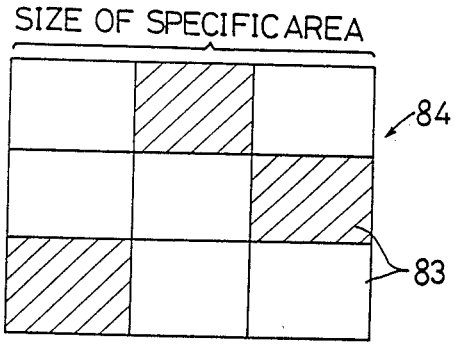
FIGS. 9A, 9B and 9C are schematic views illustrating different copy modes of the electronic photographic copier shown in FIG. 8.
Figure 9B:
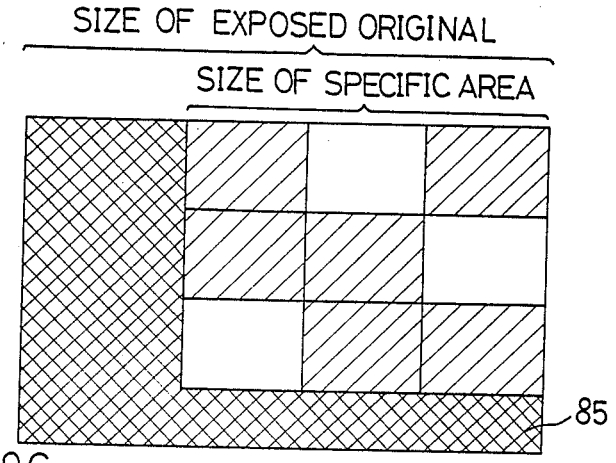
Figure 9C:
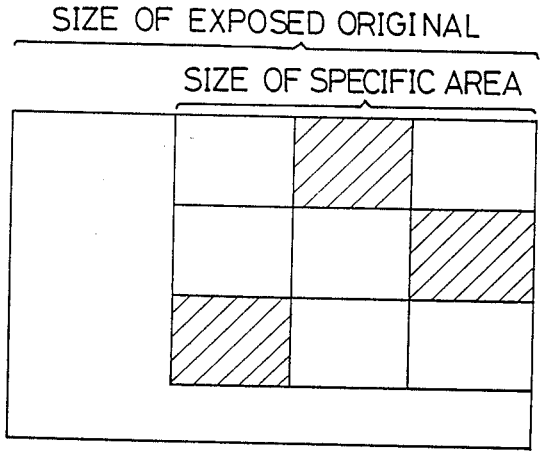

FIG. 9A shows an edit specific area 84 constituted by nine sectional blocks 83.

In the same figure, the blocks with slash lines denote those designated by the ten key. It is assumed here that this specific area 84 is smaller than the original document to be copied. If the normal edit mode is selected by the first selector switch 80 and at the same time the first copy mode is selected by the second selector switch 81, the document area to be copied is denoted by portions indicated by a slash line or a double-slash line with the double-slashed portion indicating an exposed and copied portion outside the specific edit area. Assuming that the same document is used, the same specific area and blocks are designated and if the reverse edit mode is selected by the first selector switch 80 and the second copy mode is selected by the second selector switch 81, the document area to be copied is indicated by a portion denoted by a slash line in FIG. 9C.

In addition to the above described cases, still different copy patterns are possible depending on how these two selector switches are set. However, since such cases may be easily understood from the above description, no further description will be provided.

Though not described in the previous embodiments, in the copy edit operation of the original document M, such arrangements are also possible as follows. For example, by controlling the timing of delivering the recording paper P into the transfer separator 9 or by adapting a manual feeding type paper supply device to be movable in a direction normal to the document scanning direction, the visible image of the light from the blocks to be copied of the document M may be formed in various places. Or, visible images of the lights from different blocks of the document M may be formed adjacent each other on the recording paper P.

In place of the DC motor as a driving device for the scanning device S used in the previous embodiment, a stepping motor or other kinds of motors may be also employed. If a stepping motor is employed, by counting the number of pulses for driving this motor, it is possible to detect the position of the scanning device 9 without using the optical encoder employed in the previous embodiment.

In place of the photosensitive drum 6, a belt type photosensitive member expandedly provided between a pair of rollers may be used. These drum and belt member are generically referred to as the photosensitive member 6.

Further, in the previous embodiment, the original document M is fixedly positioned on the document table 1 while the exposure lamp 2 and the slit 3 are movable relative thereto. In place of this arrangement, the present invention may also be embodied in a copier constructed such that the exposure lamp 2 and the slit 3 are fixedly provided while the document table 1 is movable.

Also, in the previous embodiment, the present invention was described by way of example of the electronic photographic copier. However, the present invention will find its applications also in e.g. a microfilm printer capable of obtaining an enlarged image of a micro image formed on a microfilm. These devices are generically referred to as the image forming apparatus.

In the case of the electronic photographic copier described in the previous embodiment, since the positive image is obtained from the positive type original document M, the operations of the sub-eraser lamp 16 and the lamp regulator 72 therefor are controlled by the divisional developing function DM. In contrast to this, if the copier is of a negative type in which a positive image is obtained from the negative type original document M, in place of the sub-eraser lamp 16 a shutter may be provided for blocking light from the portion of the document not to be copied and the operations of the driving mechanism for projecting and receding into and from the image forming optical path of the image forming optical unit I may be controlled by the divisional developing function DM.

We claim:

1. An image forming apparatus comprising:
original exposure means for exposing an original in a predetermined exposure area, the exposure area being divided into a plurality of specific areas;
specific area designating means for selectively designating one of the specific areas in the exposure area, each of said specific areas further including a plurality of sectional blocks:
sectional block designating means for designating at least one sectional block from the plurality of blocks of a designated specific area; and
image forming means for reproducing an image of the oiriginal corresponding to the sectional blocks except for said one or more designated blocks inside said designated specific area.

2. An image forming apparatus, as defined in claim 1, wherein said image forming means also reproduces an image corresponding to outside of said designated area in the exposure area.

3. An image forming apparatus, as defined in claim 1, wherein said sectional block designating means includes numerical value input means and a desired sectional block is designated by a numerical value input by said numerical value input means.

4. An image forming apparatus comprising:
original exposure means for exposing an original in a predetermined exposure area, the exposure area being divided into a plurality of specific areas;
specific area designating means for selectively designating one of said specific areas in the exposure area, said specific area including a plurality of sectional blocks;
sectional block designating means for designating at least one sectional block from the plurality of blocks of said designated specific area; and
image forming means for reproducing an image of the original corresponding to the designated sectional block inside said designated specific area.

5. An image forming apparatus, as defined in claim 4, wherein said image forming means also reproduces an image of the original positioned in the exposure area and at the same time outside the specific area.

6. An image forming apparatus, as defined in claim 4, wherein said sectional block designating means includes numerical value input means and a desired sectional block is designated by a numerical value input by said numerical value input means.

7. An image forming apparatus comprising:
original exposure means for exposing an original in a predetermined exposure area;

specific area designating means for selectively designating a certain specific area in the exposure area from a plurality of specific areas each having a different size, said specific area including the same number of sectional blocks;

sectional block designating means for designating at least one desired sectional block from the plurality of blocks constituting said specific area;

first selector means for selecting either of a normal edit mode for reproducing an image of the original corresponding to said designated sectional block and a reverse edit mode for reproducing an image of the original corresponding to sectional blocks except outside of said designated sectional block;

second selector means for selecting either of a first copy mode for reproducing also an image corresponding to outside of said designated specific area of the original positioned in the exposure area and a second copy mode for erasing an image corresponding to outside of the original positioned in the exposure area, and image forming means for reproducing an image of the original in accordance with modes set by said first and second selector means.

8. An image forming apparatus comprising:

original exposure means for exposing an original in a predetermined exposure area, the exposure area being divided into a plurality of specific areas;

specific area designating means for selectively designating one of the specific areas in the exposure area, said specific areas being different in size and each including a same number of sectional blocks;

sectional block designating means for designating at least one sectional block from the plurality of blocks of a designated area, and image forming means for reproducing an image of the original corresponding to the sectional blocks except for any designated block inside said designated specific area.

9. An image forming apparatus comprising:

original exposure means for exposing an original in a predetermined exposure area, the exposure area being divided into a plurality of specific areas;

specific area designating means for selectively designating one of said specific areas in the exposure area, said specific areas being different in size and each including the same number of sectional blocks;

sectional block designating means for designating at least one sectional block from the plurality of blocks, and image forming means for reproducing an image of the original corresponding to the designated sectional block inside said designated specific area.

10. A method for controlling an image forming apparatus having a predetermined exposure area for exposing an original document comprising the steps of:

selectively designating one of several specific areas in the exposure area, said specific areas each including a plurality of sectional blocks;

designating at least one sectional block from the plurality of blocks of the designated area, and reproducing an image of the original corresponding to the sectional blocks except for said designated block inside said designated specific area.

11. A method for controlling an image forming apparatus having a predetermined exposure area subdivided into a plurality of specific areas for exposing an original document, comprising the steps of:

selectively designating one of several specific areas in the exposure area, said specific areas being different in size and each including the same number of sectional block;

designating at least one sectional block from the plurality of blocks of a specific area, and reproducing an image of the original corresponding to the sectional blocks except for said designated block inside said designated specific area.

12. A method for controlling an image forming apparatus having a predetermined exposure area divided into a plurality of specific areas for exposing an original document, comprising the steps of:

selectively designating one of several specific areas in the exposure area, said specific area including a plurality of sectional blocks;

designating at least one sectional block from the plurality of blocks of the designated area, and reproducing an image of the original corresponding to the designated sectional block inside said designated specific area.

13. A method for controlling an image forming apparatus having a predetermined exposure area divided into a plurality of specific areas for exposing an original document comprising the steps of:

selectively designating one of the specific areas in the exposure area, said specific areas being different in size and each including the same number of sectional blocks;

designating at least one sectional block from the plurality of blocks of a designated specific area, and reproducing an image of the original corresponding to the designated sectional block inside said designated specific area.

* * * * *